US005417256A

United States Patent [19]

Hartsell, Jr. et al.

[11] Patent Number: 5,417,256

[45] Date of Patent: May 23, 1995

[54] CENTRALIZED VACUUM ASSIST VAPOR RECOVERY SYSTEM

[75] Inventors: Hal C. Hartsell, Jr., Kernersville; Kenneth L. Pope, Walkertown, both of N.C.

[73] Assignee: Gilbarco, Inc., Greensboro, N.C.

[21] Appl. No.: 131,313

[22] Filed: Oct. 4, 1993

[51] Int. Cl.[6] ..... B65B 31/00

[52] U.S. Cl. ..... 141/7; 141/45; 141/47; 141/59; 141/290

[58] Field of Search ..... 141/4, 7, 44, 45, 46, 141/47, 51, 59, 83, 198, 206, 290, 302

[56] References Cited

U.S. PATENT DOCUMENTS

| | | | |
|---|---|---|---|
| 3,899,009 | 8/1975 | Taylor | 141/59 |
| 3,941,168 | 2/1976 | Hiller et al. | 141/46 |
| 3,981,334 | 9/1976 | Deters | 141/46 |
| 4,009,985 | 3/1977 | Hirt | 431/5 |
| 4,020,861 | 5/1977 | Shihabi | 137/100 |
| 4,058,147 | 11/1977 | Stary et al. | 141/45 |
| 4,118,170 | 10/1978 | Hirt | 431/5 |
| 4,197,883 | 4/1980 | Mayer | 141/59 |
| 4,253,503 | 3/1981 | Gunn | 141/59 |
| 4,256,151 | 3/1981 | Gunn | 141/59 |
| 4,292,020 | 9/1981 | Hirt | 431/5 |
| 4,680,004 | 7/1987 | Hirt | 431/5 |
| 5,038,838 | 8/1991 | Bergamini et al. | 141/59 |
| 5,040,577 | 8/1991 | Pope | 141/59 |
| 5,156,199 | 10/1992 | Hartsell, Jr. et al. | 141/83 |
| 5,195,564 | 3/1993 | Spalding | 141/1 |
| 5,280,814 | 1/1994 | Stroh | 141/44 |
| 5,323,817 | 6/1994 | Spalding | 141/1 |
| 5,332,008 | 7/1994 | Todd et al. | 141/5 |
| 5,332,011 | 7/1994 | Spalding | 141/59 |

FOREIGN PATENT DOCUMENTS

| | | |
|---|---|---|
| 0443068A1 | 8/1991 | European Pat. Off. . |
| 2641267 | 7/1990 | France . |
| 8717378 U | 10/1987 | Germany . |
| 9007190 U | 10/1990 | Germany . |
| 4200803 | 7/1993 | Germany . |

OTHER PUBLICATIONS

Article by Gulf Science and Technology Company entitled: "The System Designed with Convenience in Mind" undated (No Date Available).

Article entitled "Gulf/Hasselmann Stage II Vapor Recovery System for Gasoline Dispensing Facilities" undated (No Available Date).

Article by Hirt Combustion Engineers entitled "This is the VCS-200 Vapor Net" dated: Jun. 1986.

*Primary Examiner*—Ernest G. Cusick
*Assistant Examiner*—Steven O. Douglas
*Attorney, Agent, or Firm*—Rhodes, Coats & Bennett

[57] ABSTRACT

A fuel dispensing system includes a main vapor recovery path and a vapor pump to provide a vacuum along the path. Dispensers for dispensing fuel from a storage tank each have a branch conduit having one end adapted to be coupled to a receiving tank, and another end opening into the main vapor path, to provide a branch vapor recovery path. A sensor provides a first electrical signal indicative of the flow of the fuel being delivered, and a vapor flow sensor in the branch conduit supplies a signal indicative of the actual vapor flow. An adjustable valve in the branch conduit has an opening that is adjustable responsive to the magnitude of a control signal to vary the impedance of the vapor recovery path. A controller generates the control signal to control the valve to maintain a desired volume of vapor flow in the branch conduit to draw fuel vapors from the receiving tank into the main path and modifies the control signal to reduce any discrepancy between a calculated vapor flow rate and the actual vapor flow signaled by the vapor flow sensor.

21 Claims, 4 Drawing Sheets

CENTRALIZED VACUUM ASSIST VAPOR RECOVERY SYSTEM

RELATED APPLICATIONS AND PATENTS

U.S. Pat. No. 5,040,577 entitled "Vapor Recovery System for Fuel Dispenser" in the name of Kenneth L. Pope, and issued Aug. 20, 1991.

U.S. Pat. No. 5,156,199 entitled "Control System For Temperature Compensated Vapor Recovery in Gasoline Dispenser" issued on Oct. 20, 1992 in the names of Hal C. Hartsell, Jr., and Kenneth L. Pope.

1. Field of the Invention

The field of the present invention relates generally to fuel dispensers, and more particularly to vapor recovery systems for use when dispensing a volatile fuel such as gasoline.

2. Background Of The Invention

U.S. Pat. No. 5,040,577, referred to above, describes a vapor recovery system in which the speed of the vapor recovery pump is set by a microprocessor rather than mechanical means so that its volumetric flow is derived from the volumetric flow of liquid into a tank. In one embodiment the volumetric flow of the vapor recovery pump is modified so as to maintain an expected pressure at its input. In another, the volumetric flow of the vapor recovery pump is modified so that it maintains an expected volumetric flow.

U.S. Pat. No. 5,156,199 referred to above describes a system for recovering vapor emerging from a tank to which liquid is being delivered wherein a vapor pump sucks vapor from the tank with a volumetric flow that is equal to the volumetric flow of the liquid as modified so as to compensate for the change in volume of the emerging vapor caused by thermal exchange with the entering liquid.

A centralized vapor recovery system for use with multiple dispensers has been proposed in U.S. Pat. No. 5,195,564 to Spalding, in which a single vapor pump draws vapor from a multiplicity of hoses, with the amount of vapor being drawn through a given hose being determined by the opening in proportioning vapor valves. Similar systems using proportioning valves to control the distribution of the vapor flow among various nozzles were earlier disclosed in the following U.S. Patents:

| | |
|---|---|
| 3,941,168 | Hiller et al. |
| 4,058,147 | Stary et al. |
| 4,253,503 | Gunn |
| 4,256,151 | Gunn |

In order to be successful in achieving sufficiently accurate control over the vapor flows, however, each dispenser should be calibrated individually to achieve a desired vapor flow. That is, the valves must be carefully calibrated to obtain the desired valve opening size, to take into account the varying resistances to flow the different hoses and nozzles may provide.

Even when this is done, however, this setup is subject to being confounded by in-the-field changes in the characteristics of the vapor piping. If deposits form on the inside of the vapor return hose, these can alter the amount of flow though the hose, throwing off the carefully-calibrated setup. Different thermal expansion may take place from one hose to another if, for example, one hose is positioned so as to be in the sunlight and another is not, a condition that may change with time of day.

Also, aging of the parts may lead to similar variations. Most dramatically, liquid in the vapor flow line, which is common, radically alters the flow of vapor through the vapor return hose. The liquid can get into the vapor hose either through condensation of the vapor or aspiration of liquid fuel. Merely locating proportioning valves in the vapor passageways leading to a common pump, as taught by Spalding and its predecessors, is not an adequate solution.

SUMMARY OF THE INVENTION

The present invention overcomes these problems by providing a fuel dispensing system including a main conduit for providing a main vapor recovery path and a vapor pump in communication with the main conduit to provide a vacuum along the main conduit. At least one dispenser for dispensing fuel from a storage tank into a receiving tank includes a branch conduit having one end adapted to be coupled to the receiving tank, and another end connected to the main conduit and opening into the main vapor path thereof, the branch conduit providing a branch vapor recovery path. A sensor provides an electrical signal indicative of the volumetric flow $V_L$ of the fuel being delivered by the dispenser, and a vapor flow sensor in the branch conduit supplies a signal indicative of the actual vapor flow. An adjustable valve operatively associated with the branch conduit has its opening adjustable responsive to the magnitude of a control signal for selectively varying the flow impedance of the vapor recovery path of the branch conduit. A controller responsive to the electrical signal generates the control signal to control the electrically operated valve to maintain a desired volume of vapor flow in the branch conduit to draw fuel vapors from the receiving tank into the main conduit and modifies the control signal to reduce any discrepancy between a calculated vapor flow rate and the actual vapor flow signaled by the vapor flow sensor.

Preferably, the vapor pump%is capable of pumping at a variable rate sufficient to draw vapor from all active dispensers. Generally, the vapor pump is capable of drawing vapor through at least two branch conduits simultaneously and a valve is controlled for each branch conduit. With the multiple dispensers and branch conduits having respective vapor valves, the controller operates the vapor pump at a variable rate sufficient to draw vapor from all active dispensers.

In one embodiment, the controller opens the valve fully if the difference between the desired vapor flow rate and the actual vapor flow rate is large enough to indicate a liquid blockage of the branch conduit.

Preferably, the dispensers each include a hose portion and the hose portion of the branch conduit is located within the hose portion of the dispenser.

The apparatus may include a sensor for providing an electrical signal $T_L$ indicative of the temperature of fuel being dispensed,a sensor for providing a signal $T_A$ representative of the temperature $T_V$ of the fuel vapor within the receiving tank, with the controller being further responsive to these signals to generate the control signal. That is, the controller may be adapted to modify the control signal to the valve in order to compensate for expansion or contraction of the vapor caused by thermal transfer between vapor and liquid.

The controller set up may take various forms. For example, one controller can be provided for all dispensers and the vapor pump, with the appropriate data input and output connections being made between the controller and the controlled dispensers. Or, each dispenser :hose may have a controller for its valve, with a master controller being provided for the vapor pump connected to the dispensers' controllers to communicate the desired vapor flow rate to each dispenser's controller. The dispenser's controller makes the comparison between the desired and actual vapor rates to output the control signal to the valve.

The invention also provides a method including the steps of delivering fuel along a first path into a receiving tank with a variable volumetric flow $V_L$, producing a electrical signal indicative of the volumetric flow $V_L$, sucking vapor from the receiving tank along a branch vapor recovery path to a main vapor recovery path, and adjusting the volumetric flow of vapor via a valve in the branch vapor recovery path to cause a calculated volumetric flow $V_R$ of vapor in the branch vapor recovery path derived from the fuel volumetric flow, $V_v$. A signal, $V_A$, is measured indicative of the actual volumetric flow of the vapor through the branch vapor recovery path and the absolute value of the difference, $|V_R-V_A|$ is derived. The valve is adjusted to change the flow rate of vapor in the branch vapor recovery path to reduce the difference, $|V_R-V_A|$.

The invention also provides a method of dispensing fuel including dispensing fuel through at least two of a plurality of fuel dispenser hoses from a storage tank into receiving tanks associated with each dispenser hose and generating a signal indicative of the volumetric flow of fuel dispensed from each hose, drawing vapor from the receiving tanks under the influence of a vacuum from a main conduit into a branch conduit for each hose, drawing vapor from the branch conduits into the main conduit, controlling the volumetric flow of vapor from the branch conduits into the main conduit with a valve for each branch conduit that variably restricts flow through the branch conduit, responsive to a desired vapor flow rate signal for that branch conduit,sensing the actual volumetric flow of the vapor through each branch conduit, deriving the difference between the desired vapor flow rate and the actual volumetric flow of the vapor for each branch conduit, and adjusting the valve for each conduit to change the flow rate of vapor in the branch vapor recovery path to reduce the difference.

Preferably, the step of drawing vapor from the branch conduits into the main conduit includes driving a vapor pump at a rate derived from the signals indicative of the volumetric flow of fuel dispensed from each hose.

The method may include producing electrical signals respectively indicative of the absolute temperatures of fuel in the first path and vapor in the receiving tank; and increasing the opening of the electrically operated vapor recovery control valve located in the branch vapor recovery path, in order to increase the volumetric flow of the vapor being sucked, when the temperature of the fuel is greater than the temperature of vapor and decreasing the opening of the electrically operated vapor recovery control valve, in order to decrease the volumetric flow of the vapor being sucked, when the temperature of the fuel is less than the temperature of vapor.

The vapor drawing step may include drawing vapor through at least two branch conduits simultaneously and a valve is controlled for each conduit.

Preferably, the dispensing step includes dispensing the fuel through a liquid-conveying hose, and the drawing vapor step includes drawing vapor through a hose portion of the branch conduit located within the liquid-conveying hose.

Desirably, the vapor drawing step includes pumping at a variable rate sufficient to draw vapor from all active dispensers.

The adjusting step may include opening the valve fully if the difference between the desired vapor flow rate and the actual vapor flow rate is large enough to indicate a liquid blockage of the branch conduit.

DETAILED DESCRIPTION OF A PREFERRED EMBODIMENT

Figure 1A:
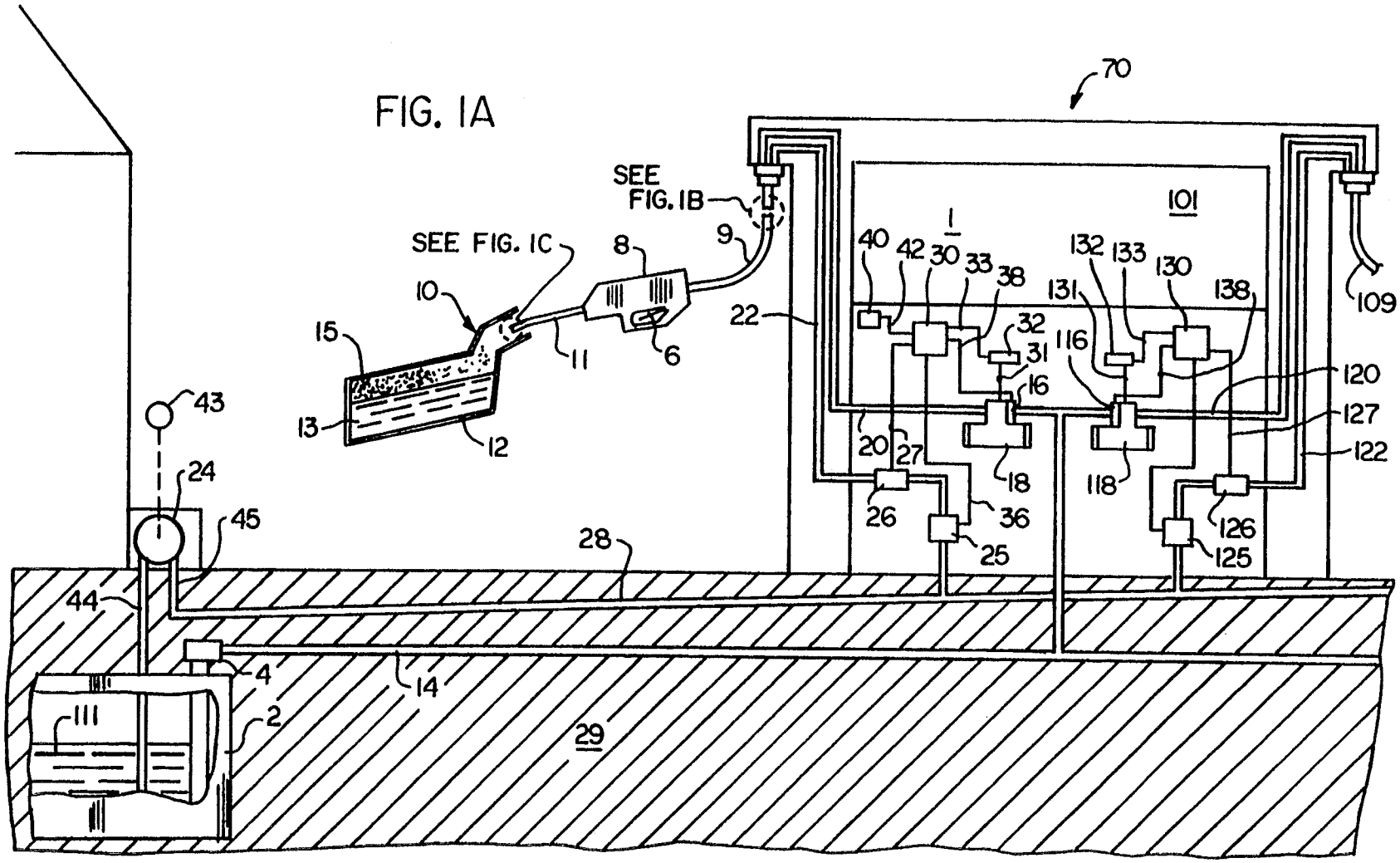
FIG. 1A is a schematic representation of the delivery system for volatile liquid constructed in accordance with the invention.

FIG. 1A shows a multi-position dispenser, such as are commonly seen in contemporary service stations in which a single housing 70 includes apparatus to permit the fueling of two or more vehicles simultaneously. The two vehicles are usually on opposite sides of the housing, parked in suitably provided drives. The FIG. 1A embodiment shows two fueling or dispensing positions 1 and 101 on the common housing 70. Only the components of position 1 will be discussed in detail, but the components of position 101 are also shown, with reference numbers to identical parts augmented by 100.

Figure 1B:
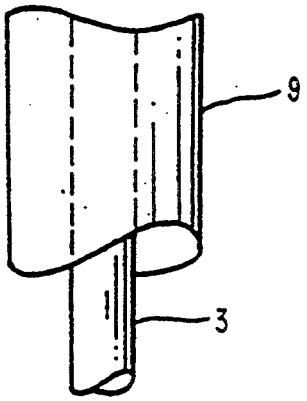
FIG. 1B is an enlargement of a section through interior view of section 9 of FIG. 1A of a coaxial hose assembly used in conjunction with one embodiment of the invention.
Figure 1C:
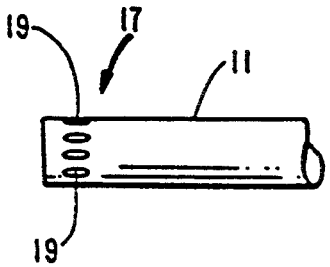
FIG. 1C is an enlarged view of a noble tip area 17 of FIG. 1A.

In the embodiment of the invention shown in FIG. 1A, liquid is pumped from a reservoir 2 by a pump 4 with a volumetric flow $V_L$ that is controlled in a manner, not shown, by the position of a trigger 6 of a nozzle 8 associated with the dispensing position 1. The nozzle 8 may be constructed as described in U.S. Pat. No. 4,199,012 to Lasater, for example, and is inserted into the fill pipe 10 of a tank 12 that is to be filled with liquid 13. The nozzle 8 may also be constructed with a dispensing end 17 (as shown in FIG. 1C) having circumferential orifices or holes 19 for sucking vapors into a vapor return path for delivery through the nozzle to a vapor return hose (such a nozzle is manufactured by Dover Corporation, OPW Division, Cincinnati, Ohio). The liquid is typically a fuel such as gasoline. The liquid flows to the nozzle 8 from the pump 4 via a tube or pipe 14, a temperature transducer 16, a flow meter 18, and a tube or pipe 20. As vapor 15 is forced from the tank 12, it is drawn through spout 11 of nozzle 8, a vapor hose 3 that is coaxial within a product hose 9 (see FIG. 1B), in this example, and a vapor recovery branch line or conduit 22 by a vapor recovery or suction pump 24. The latter forces the vapor through a flow meter 26, a vapor flow control valve 25 and a main or centralized vapor recovery line 28, to the reservoir 2. The flow meter 26 provides electrical signals indicative of the volumetric flow of vapor .through the branch line 22. The sensor used as the flow meter 26 can be of any suitable design. Note in this example that the cross-hatched area 29 of FIG. 1A is underground.

Figure 3:
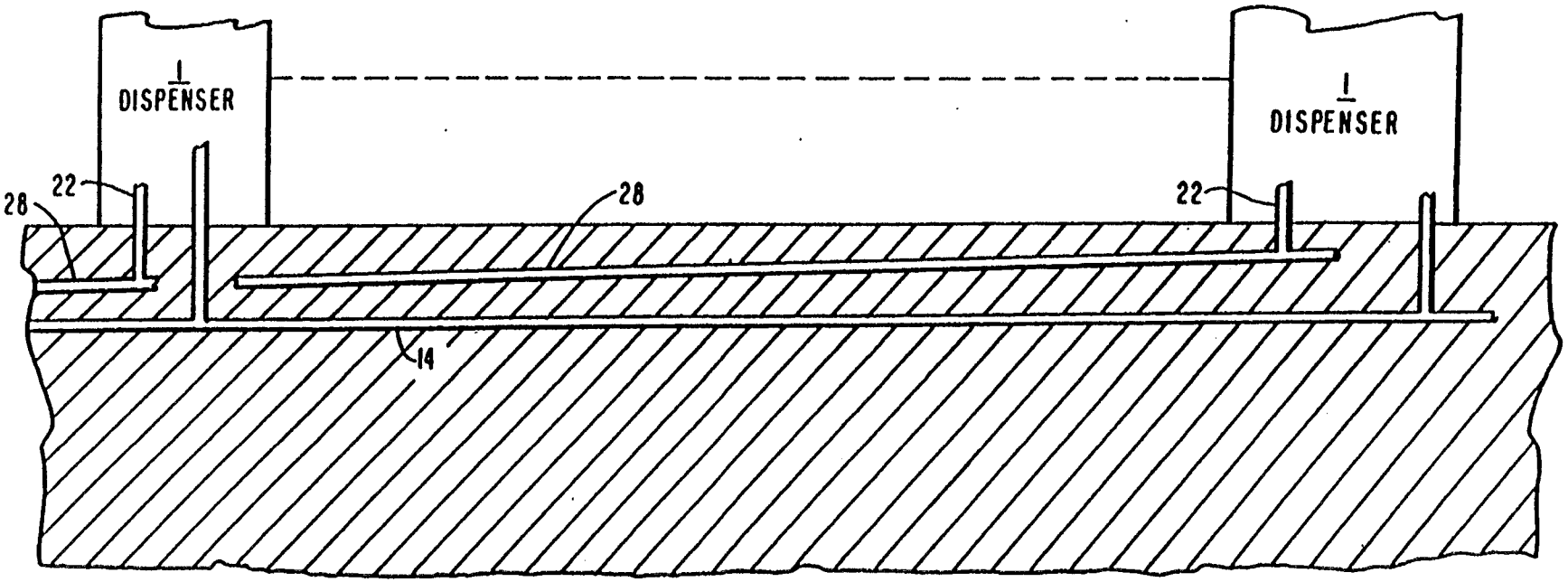
FIG. 3 is a schematic representation of another embodiment of the invention.

The vapor recovery pump 24 and other such pumps that may be required are centrally located and are sized to generate a suction which is equal to or greater than the suction needed for the branch lines 22 that are in operation at any given time. In a typical application, a plurality of branch lines 22 associated with several dispensers 1 are connected in parallel with one another to the main vapor recovery line 28 (see FIG. 3). The electronic controller 30 in each dispenser controls the operation of a vapor flow control valve 25 for that dispenser located in the vapor recovery path of the branch line 22 in the dispenser. The electronic controller may be a programmed microprocessor, but other circuits may be used, as will be apparent to those of ordinary skill in the art. If desired, a single, more elaborate microprocessor or other electronic control could be used to control the valves in multiple branch lines.

Therefore, a simple pump and motor design, such as a centrifugal pump 24 driven by a constant speed AC motor 43 may be used, for example. This concept lowers the cost of the vapor recovery system and simplifies the packaging of the vapor recovery components into the dispenser, relative to prior systems. Alternatively and preferably, the pump may be driven by a variable speed motor, with a speed control for the motor to drive the motor at a speed to collect all of the vapors from all currently active hoses, understanding that the speed will be affected by the number of hoses which are active and their respective liquid rates. This latter design is preferred, because by limiting the vapor flow to that which is needed to recover the vapor, the potential for undesirable pressurization of the underground tanks and piping is avoided or minimized.

A controller 30 initially regulates the vapor flow control valve 25 in such a way as to adjust the opening of this valve 25, for controlling the flow in the vapor recovery branch line 22 to produce a calculated volumetric flow $V_R$ in the branch line correlated with the volumetric flow $V_L$ of the liquid in its associated hose. Preferably, the boost concept of co-pending application of Edward A. Payne et al. entitled "High Efficiency Recovery Fuel Dispensing" Ser. No. 968,595, filed on Oct. 29, 1993, is used. That disclosure is hereby incorporated by reference. Other calculations, such as Spalding's 1:1.3 liquid:vapor fixed ratio, could be used, if desired, but that is not preferred. Signals from the liquid flow meter 18 are produced via a pulser 32 which is driven by shaft 31 for producing drive signals or pulses to drive a vapor flow control valve 25. Output signals from pulser 32 are connected via lead 33 to microprocessor 30 (or other electronic controller). The frequency of the drive pulses supplied by the pulser 32 varies with product flow rate and is modified as necessary as an input to valve 25 to cause the flow rate in the vapor recovery branch line 22 to be adjusted via valve 25 to cause $V_R$ to have the desired value derived from $V_L$.

As described in applicants' prior U.S. Pat. No. 5,156,199, the desired volumetric flow in the recovery branch line 22 may be modified by additional adjustments to accommodate thermal changes in volume of the vapor emanating from the tank 12. The signal provided by the temperature transducer 16 representing the temperature, $T_L$, of the liquid flowing to the tank 12 is conducted to the electronic controller 30 via a lead 38. A temperature transducer 40 supplies a signal representing the atmospheric or ambient temperature $T_A$ (which is assumed to approximate the temperature of the vapor in tank 12) to the electronic controller 30 via a lead 42. (The dispensing position 101 is not provided with its own transducer, since the temperature will be the same as that sensed by transducer 40. Its controller 130 can be suitably coupled to the transducer 40 through additional wiring, not shown.) Alternatively, an offset of $T_A$, such: as $T_A+20°$ F., can be used, on the assumption that the vehicle temperature will be 20 degrees warmer. The electronic controller 30 modifies the control signal supplied by the drive pulse source or pulser 32 in a manner described in FIG. 2 to adjust the opening of the vapor flow valve 25 to change the calculated volumetric flow $V_R$ in the recovery branch line 22. For example, the value of $V_R$ may be changed from $$V_R=V_L \text{ to}$$

$$V_R=V_L\times T_L/T_A$$

If desired, the equation may include other variables or constants selected according to geometric or other parameters.

Figure 2:
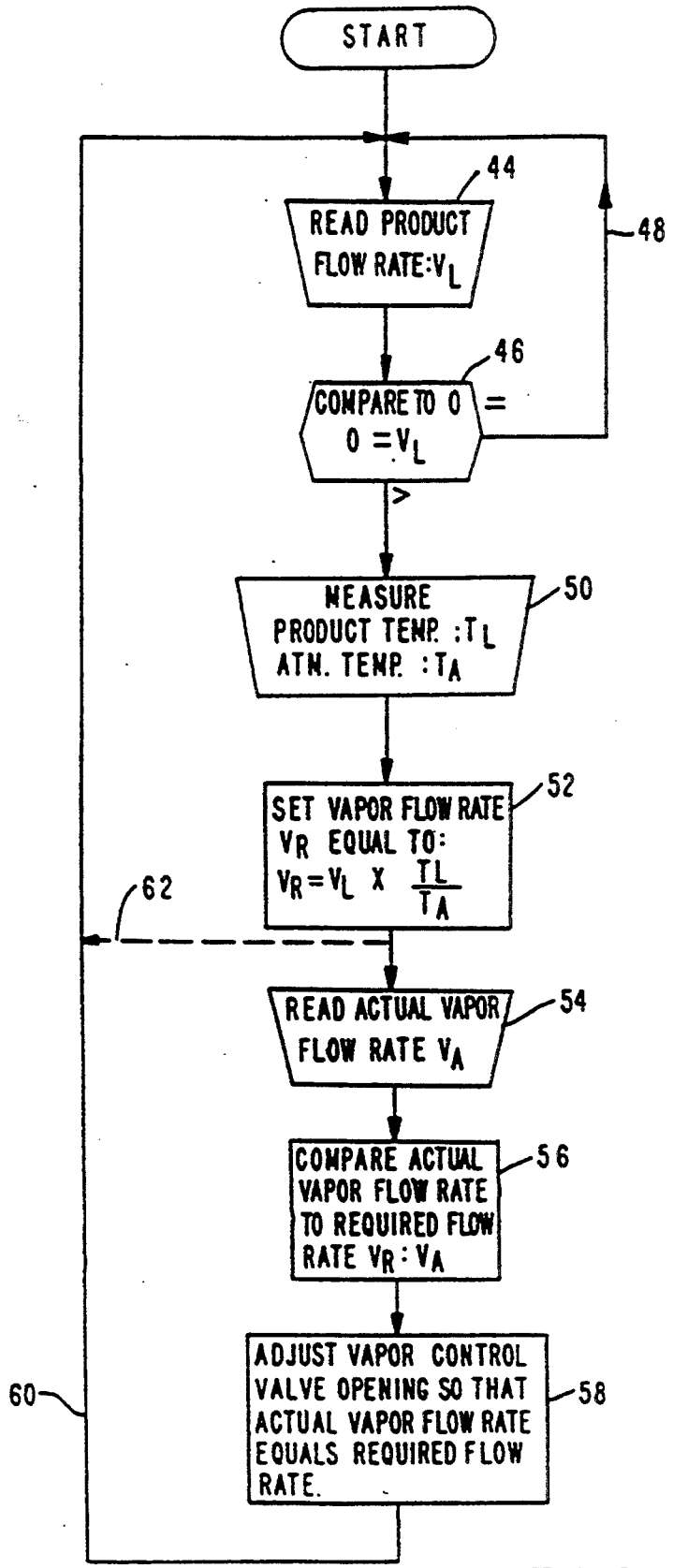
FIG. 2 is a flow chart used in explaining the operation of the delivery system shown in FIG. 1.

Reference is now made to the flow chart of FIG. 2. At the start of the program, the electronic controller 30 reads the signal $V_L$ on the lead 33 as indicated by a block 44. A determination is made as to whether any liquid is flowing by comparing $V_L$ With zero, block 46. If $V_L=0$, the processes return to the block 44, as shown by line 48.

When block 46 indicates that $V_L>0$, a block 50 indicates that the electronic controller 30 reads the signals on the leads 38 and 42, representing the temperature, $T_L$, of the liquid and the temperature, $T_A$, of the atmosphere, respectively. In block 52, the signal supplied to the vapor flow control valve 25, to open the valve and adjust the flow rate to the calculated flow rate $V_R$, is computed as:

$$V_R=V_L T_L T/T_A$$

Alternatively, the signal $V_R$ supplied to the vapor flow control valve 25 could be modified in other ways depending on various parameters including the geometry of the piping and/or based on empirically derived variables.

Thus far, it has been assumed that the actual volumetric flow $V_A$ through the vapor flow control valve 25 corresponds precisely to the calculated value $V_R$. But as indicated previously, this may not always be the case because of mechanical valve wear and variations within tolerance limits. Other changes to the system characteristics may result from the installation of a new hose or nozzle, or from the presence of liquid or deposits in the vapor line or differential thermal expansion of vapor recovery components from one hose to another. Thus, the microprocessor reads the signal on the lead 27 (see FIG. 1) representing actual vapor flow, $V_A$, as indicated by block 54 (see FIG. 2) and compares it with the calculated value $V_R$, which it has computed as indicated in block 56. It then outputs a signal to the vapor flow control valve 25 to make $V_A=V_R$, as indicated by a block 58. The process then returns to the start at the block 44. Using conventional microprocessor techniques, the process is repeated rapidly enough to follow changes in the volumetric flow of liquid $V_L$, as well as changes in other parameters such as $T_L$, and $T_A$. The output of block 58 may be a signal which adjusts the opening in the vapor valve very rapidly. Thus, a slug of liquid which is blocking the vapor return line would be noticed by $V_A << V_R$, and the valve can be opened fully to put maximum vacuum on the clogged line to clear it rapidly. Also, the vapor pump may be accelerated to assure that the vacuum to any other active vapor lines does not unduly diminish.

Although various embodiments of the invention have been illustrated and described herein, they are not meant to be limiting. Modifications to these embodiments may become apparent to those of skill in the art, which modifications are meant to be covered by the spirit and scope of the appended claims.

For example, the vapor pump may operate at a substantially constant volumetric throughput speed and have a bypass valve in parallel to limit how high the pressure differential across the pump can become, such as is shown in U.S. Pat. No. 4,082,122 to McGahey.

What is claimed is:

1. In a fuel dispensing system, the combination comprising:

a main conduit for providing a main vapor recovery path and a variable speed vapor pump in communication with said main conduit to provide a vacuum along said main conduit;

a regulator operatively engaged to said variable speed vapor pump to control said pump so that it pumps at a volumetric flow rate derived from a liquid volumetric flow rate; and at least one dispenser for dispensing fuel from a storage tank into a receiving tank, including:

a branch conduit having one end adapted to be coupled to the receiving tank, and another end connected to said main conduit and opening into said main vapor path thereof, said branch conduit providing a branch vapor recovery path;

a sensor for providing a first electrical signal indicative of the volumetric flow rate $V_L$ of said fuel being delivered by said dispenser;

a vapor flow sensor in said branch conduit supplying a signal indicative of the actual vapor flow rate;

an adjustable valve operatively associated with said branch conduit, with its opening being adjustable responsive to the magnitude of a control signal for selectively varying the impedance of said vapor recovery path of said branch conduit; and a controller responsive to said electrical signal, for generating said control signal to control said electrically operated valve to maintain a desired volume of vapor flow in said branch conduit to draw fuel vapors from the receiving tank into said main conduit and adapted to modify the control signal to reduce any discrepancy between a calculated vapor flow rate and the actual vapor flow signaled by said vapor flow sensor.

2. The fuel dispensing system as claimed in claim 1 wherein said vapor pump is capable of pumping at a variable rate sufficient to draw vapor from all active dispensers.

3. The fuel dispensing system as claimed in claim 1 wherein said vapor pump draws vapor through at least two branch conduits simultaneously and a valve is controlled for each branch conduit.

4. The fuel dispensing system as claimed in claim 1 wherein said controller opens the Valve fully if the difference between the desired vapor flow rate and the actual vapor flow rate is large enough to indicate a blockage of the branch conduit with liquid.

5. The fuel dispensing system of claim 1, wherein said dispenser further includes:

a second sensor for providing a second electrical signal $T_L$ indicative of the temperature of fuel being dispensed;

a third sensor for providing a third electrical signal $T_A$ representative of the temperature $T_V$ of the fuel vapor within the receiving tank; and said controller being further responsive to said first, second and third electrical signals to generate the control signal.

6. The fuel dispensing system of claim 5, wherein said controller includes:

an electronic controller adapted to supply the control signal to said valve in order to substantially achieve the calculated volume of vapor flow in said branch conduit such that the volume of vapor flow is modified to compensate for expansion or contraction of the vapor caused by thermal transfer between vapor and liquid.

7. The fuel dispensing system of claim 6, further including a plurality of said dispensers, each having their respective branch conduits connected at one end to said main conduit.

8. The fuel dispensing system of claim 1, further including a plurality of said dispensers, each having their respective branch conduits connected at one end to said main conduit.

9. The fuel dispensing system of claim 1 wherein said controller responds to large discrepancies between the calculated vapor flow rate and the actual vapor flow rate of a branch conduit by fully opening the valve in that branch conduit.

10. The fuel dispensing system of claim 1 wherein said controller operates the vapor pump at a variable rate sufficient to draw vapor from all active dispensers.

11. In a fuel dispensing system, the combination comprising:

a main conduit for providing a main vapor recovery path and a vapor pump associated with said main conduit to provide a vacuum along said main conduit;

a plurality of dispensing positions for dispensing fuel from a storage tank into a receiving tank, each dispensing position including:

a branch conduit having one end adapted to be coupled to an associated receiving tank, and another end connected to said main conduit and opening into said main vapor path thereof, said branch conduit providing a branch vapor recovery path;

a sensor for providing a first signal indicative of the volumetric flow rate $V_L$ of said fuel being delivered by said dispensing position;

a vapor flow sensor in said branch conduit supplying a second signal indicative of the actual vapor flow rate through the branch circuit;

a variably openable valve located within said branch conduit, responsive to the magnitude of a control signal for selectively obstructing said vapor recovery path of said branch conduit; and an electronic controller responsive to said first and second signals for each dispensing position, for generating the control signals to control said valves to substantially achieve a volumetric vapor flow in each branch conduit to draw fuel vapors from the receiving tank associated with each dispensing position into said main conduit while reducing any discrepancy between a calculated vapor flow rate and the indicated actual vapor flow.

12. A method of dispensing fuel comprising:

dispensing fuel through at least two of a plurality of fuel dispenser hoses from a storage tank into receiving tanks associated with each dispenser hose and generating a signals indicative of the volumetric flow rate of fuel dispensed from each hose;

operating a vapor pump in a main conduit to pump vapor at a variable volumetric rate derived from the sum of the volumetric flow rates of the dispensed fuel;

drawing vapor from the receiving tanks under the influence of the vapor pump into a branch conduit for each hose and into the main conduit;

controlling the volumetric flow rate of vapor from the branch conduits into the main conduit with a valve for each branch conduit that variably restricts flow through the branch conduit, responsive to a desired vapor flow rate signal for that branch conduit;

sensing the actual volumetric flow rate of the vapor through each branch conduit;

deriving the difference between the desired vapor flow rate and the actual volumetric flow rate of the vapor for each branch conduit; and adjusting the valve for each conduit to change the flow rate of vapor in the branch vapor recovery path to reduce the difference.

13. In a fuel dispensing system, a method comprising the steps of:

delivering fuel to a first tank along a first path with a first variable volumetric flow rate;

delivering fuel to a second tank along a second path with a second variable volumetric flow rate;

producing an electrical signal indicative of the sum of the first and second volumetric flow rates;

sucking vapor from the tanks in response to the electrical signal indicative of the sum in a main vapor recovery path;

directing vapor from the tanks along first and second branch vapor recovery paths to the main vapor recovery path;

producing second and third electrical signals respectively indicative of the absolute temperatures of fuel in the first path and vapor in the first tank; and increasing the opening of an electrically operated vapor recovery control valve located in the first branch vapor recovery path, in order to increase the volumetric flow rate of the vapor being sucked, in response to the second and third electrical signals, when the temperature of the fuel is greater than the temperature of vapor and decreasing the opening of the electrically operated vapor recovery control valve, in order to decrease the volumetric flow rate of the vapor being sucked, in response to the second and third electrical signals, when the temperature of the fuel is less than the temperature of vapor.

14. The method of claim 13, further comprising the steps of:

calculating from the second and third electrical signals an indication of the calculated volumetric flow rate of vapor required to remove the vapor displaced from the receiving tank by delivery of the fuel thereto;

producing an indication of the actual volumetric flow rate in the first branch vapor recovery path of vapor produced by sucking back vapor at a given time; and adjusting the vapor recovery control valve in order to adjust the volumetric flow rate of vapor in the first branch vapor recovery path in response to the indication of the calculated vapor flow and the indication of the actual vapor flow, to reduce any differences in the rates of actual vapor flow and calculated vapor flow.

15. In a fuel dispensing system including a plurality of fuel dispensers for dispensing fuel from a storage tank to a receiving tank, respectively, and vapor recovery apparatus, the latter including a main vapor recovery path, a method of vapor recovery for each of the plurality of fuel dispensers comprising the steps of:

producing a first electrical signal indicative of the volumetric flow rate $V_L$ of fuel being dispensed from an associated dispenser;

producing a second electrical signal corresponding to the absolute temperature, $T_L$, of fuel being delivered to the receiving tank;

producing a third electrical signal corresponding to the temperature, $T_V$, of vapor in the receiving tank;

sucking vapor from the tank along a branch vapor recovery path that is adjacent to the first path and having one end connected to a main vapor recovery path; and adjusting the flow rate of vapor via an electrically operated valve in the branch vapor recovery path in response to the signals $V_L$, $T_L$, and $T_V$ to cause a calculated volumetric flow rate $V_R$ of vapor that may differ from a nominal volumetric flow rate.

16. The method of claim 15, further including the steps of deriving a fourth signal, $V_A$, representing actual volumetric flow rate of the vapor recovery apparatus;

deriving the difference, $V_R - V_A$; and responsive to the difference adjusting the valve to change the flow rate of vapor in the branch vapor recovery path to produce the calculated volumetric flow rate $V_R$ so that $V_A$ approximates $V_R$.

17. A method of dispensing fuel comprising:

dispensing fuel through one of a plurality of fuel dispensers from a storage tank into a receiving tank and generating a signal indicative of the volumetric flow rate of fuel dispensed;

drawing vapor from the receiving tank under the influence of a vacuum from a main conduit into a branch conduit in the fuel dispenser and into said main conduit;

controlling the volumetric flow rate of vapor from the branch conduit into the main conduit with an electrically operated valve that variably restricts flow through the branch conduit, responsive to a desired vapor flow rate signal;

sensing the actual volumetric flow rate of the vapor through the branch conduit;

deriving the difference between the desired vapor flow rate and the actual volumetric flow rate of the vapor through the branch conduit; and adjusting the valve to change the flow rate of vapor in the branch vapor recovery path to reduce the difference.

18. A method as claimed in claim 17 wherein said dispensing step includes dispensing the fuel through a liquid-conveying hose and said drawing vapor step includes drawing vapor through a hose portion of the branch conduit located within said liquid-conveying hose.

19. The fuel dispensing method as claimed in claim 17 wherein said vapor drawing step includes pumping at a variable rate sufficient to draw vapor from all active dispensers.

20. The fuel dispensing method as claimed in claim 17 wherein said vapor drawing step includes drawing vapor through at least two branch conduits simultaneously and a valve is controlled for each conduit.

21. The fuel dispensing method as claimed in claim 17 wherein said adjusting step includes opening the valve fully if the difference between the desired vapor flow rate and the actual vapor flow rate is large enough to indicate a liquid blockage of the branch conduit.

* * * * *